US006360702B1

(12) United States Patent
Osada

(10) Patent No.: US 6,360,702 B1
(45) Date of Patent: Mar. 26, 2002

(54) EGR AND OIL COOLING SYSTEM

(75) Inventor: Hideki Osada, Kawasaki (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/707,637

(22) Filed: Nov. 7, 2000

(30) Foreign Application Priority Data

Nov. 10, 1999 (JP) ..... 11-319914

(51) Int. Cl.[7] ..... F01P 1/06

(52) U.S. Cl. ..... 123/41.31; 123/41.33; 123/196 AB

(58) Field of Search ..... 123/41.31, 41.33, 123/196 AB; 184/6.22

(56) References Cited

FOREIGN PATENT DOCUMENTS

JP 07042628 A 2/1995
JP 10002256 A 1/1998
JP 10169514 A 6/1998

*Primary Examiner*—Noah P. Kamen
(74) *Attorney, Agent, or Firm*—McCormick, Paulding & Huber LLP

(57) ABSTRACT

A system (1) for cooling EGR gas and lubrication oil, which is compact, resistive to vibration, and heats the lubrication oil at cold start of an engine (2) while cooling EGR gas. A system housing (10) is directly attached to a lateral wall of a cylinder block (3) such that engine cooling water flows therein. An EGR gas heat exchanger (16) and oil heat exchanger (15) are located in the housing (10) and immersed in the cooling water. Since the two heat exchangers (15, 16) are placed close to each other, high temperature EGR gas flowing in the EGR gas heat exchanger (16) heats low temperature lubrication oil flowing in the oil heat exchanger (15) via the cooling water when the engine (2) is cold. As a result, the viscosity of the lubrication oil drops and it assists easier start up of the engine under a cold condition. Since the single housing (10) is shared by the two heat exchangers (15, 16), the system (1) is compact.

8 Claims, 7 Drawing Sheets

EGR AND OIL COOLING SYSTEM

BACKGROUND OF THE INVENTION

1. Field of the Invention

The present invention relates to a system for cooling an EGR (exhaust gas recirculation) gas and lubrication oil with engine cooling water.

2. Description of the Related Art

Systems for cooling an EGR gas with engine cooling water are known in the art. By cooling the EGR gas, the gas density is raised and EGR efficiency is improved. This type of conventional systems is called an EGR cooler, and one example thereof is disclosed in Japanese Patent Application, Laid Open Publication No. 10-169514 and illustrated in FIG. 8 of the accompanying drawings.

The EGR cooler 70 includes a generally cylindrical casing 72 extending between an exhaust gas line of an engine (exhaust manifold) and an intake air line (intake manifold). The casing 72 is divided into three chambers, namely, a gas inlet chamber 74, cooling water chamber 76 and gas outlet chamber 78, by two partition walls 80. A plurality of heat exchange pipes 82 extend in the cooling water chamber 78 and span the partition walls 80. The cooling water chamber 76 has a cooling water inlet 84 for introducing part of water, which is primarily used for cooling an engine, into the cooling water chamber. The cooling water chamber 76 also has a cooling water outlet 86 for discharging the water therefrom. An air ventilation 88 is further provided on the cooling water chamber 76 for allowing air, which is generated from the heated water, to escape from the cooling water chamber 76.

When the exhaust gas (high temperature gas) discharged from the exhaust manifold is partly recirculated to the intake manifold by an EGR line, that exhaust gas flows in the heat exchange pipes 82 and is cooled by the cooling water flowing in the cooling water chamber 76. This raises gas density of the exhaust gas and in turn EGR efficiency.

The EGR cooler 70 should be located between the exhaust and intake manifolds, but there is a cylinder head near the manifolds. Thus, only a limited space is available for the EGR cooler 70. Further, an engine hood and other structures associated with a vehicle body also exist in this area. In actuality, therefore, it is sometimes difficult to install the EGR cooler 70.

Moreover, since the cooling water is taken from the engine, introduced into the EGR cooler 70 and returned to the engine again, water pipes are required to connect the engine to the water inlet 84 and the water outlet 86 to the engine and at least one air pipe is needed for the air outlet 88. These pipes are subjected to vibrations when the engine is running and vehicle is cruising, and may have crack. To avoid it, the pipes must be firmly secured onto the engine with brackets and the like.

In addition, the EGR cooler 70 is completely independent from an oil cooler for cooling an engine lubrication oil, if any, so that it is not possible for the EGR gas to heat the lubrication oil (engine oil) in the oil cooler. Viscosity of the engine oil is generally low at low temperature starting.

Japanese Patent Application Laid-Open Publication No. 10-2256 discloses an EGR gas cooler using engine cooling water, and 7-42628 discloses an EGR gas cooler attached to a lateral wall of a cylinder block.

SUMMARY OF THE INVENTION

An object of the present invention is to overcome the above described problems.

Specifically, one object of the present invention is to provide a compact arrangement for cooling an EGR gas.

Another object of the present invention is to provide an EGR gas cooling system which is resistive to vibrations.

Still anther object of the present invention is to provide an EGR cooling arrangement which can also heat a lubrication oil when the lubrication oil temperature (or engine temperature) is low.

From another point of view, one object of the present invention is to provide an arrangement for cooling an EGR gas and lubrication oil, which is compact, does not vibrate and can heat the lubrication oil while cooling the EGR gas.

According to one aspect of the present invention, there is provided a system for cooling EGR gas and oil including a housing directly attached to a cylinder block such that engine cooling water flows in the housing, an EGR gas heat exchanger placed in the housing such that EGR gas flows in the EGR gas heat exchanger, and an oil heat exchanger placed in the housing adjacent to the EGR gas heat exchanger such that a lubrication oil flows in the oil heat exchanger. Since the two heat exchangers are located adjacent to each other and immersed in the cooling water in the housing, no piping is needed for introducing the cooling water into the housing. This improves resistance to vibration and reduces installation space. Further, since the two heat exchangers are closely located, heat of the high temperature EGR gas flowing in the EGR heat exchanger is transferred to the low temperature lubrication oil flowing in the oil heat exchanger via the cooling water when the engine is started under a cold condition. Thus, the lubrication oil is heated and its viscosity is lowered. This is particularly advantageous at the cold starting of the engine because the engine oil has high viscosity and the heated oil assists easier start up of the engine and reduces oil pump friction.

An opening may be formed in a lateral wall of the cylinder block such that part of a water jacket is exposed, and the housing (or a cover) covers the opening watertight such that the engine cooling water flows into the cover from the water jacket and vice versa. The EGR gas heat exchanger and oil heat exchanger are placed in the cover. Since the single opening is shared by the two heat exchangers, rigidity deterioration of the cylinder block due to making an opening is suppressed to the minimum. This also contributes to vibration reduction.

The oil heat exchanger may include a plurality of thin plate-like hollow members immersed in the engine cooling water in the housing, and the EGR gas heat exchanger may likewise include a plurality of thin plate-like hollow members immersed in the engine cooling water in the housing. The cooling system may include a first passage for introducing an exhaust gas to the EGR gas heat exchanger from an exhaust manifold and a second passage for introducing the exhaust gas to an intake manifold from the EGR gas heat exchanger. The housing may be shaped to guide air generated upon heating of the engine cooling water in the housing to a water jacket thereby allowing the air to escape to a cylinder head Therefore, the air ventilation pipe required in the conventional EGR cooler shown in FIG. 8 is unnecessary for the cooling system of the invention.

Additional objects, benefits and advantages of the present invention will become apparent to those skilled in the art to which this invention relates from the subsequent description of the embodiments and the appended claims, taken in conjunction with the accompanying drawings.

DETAILED DESCRIPTION OF THE INVENTION

Now, an embodiment of the present invention will be described in reference to the accompanying drawings.

Figure 1:
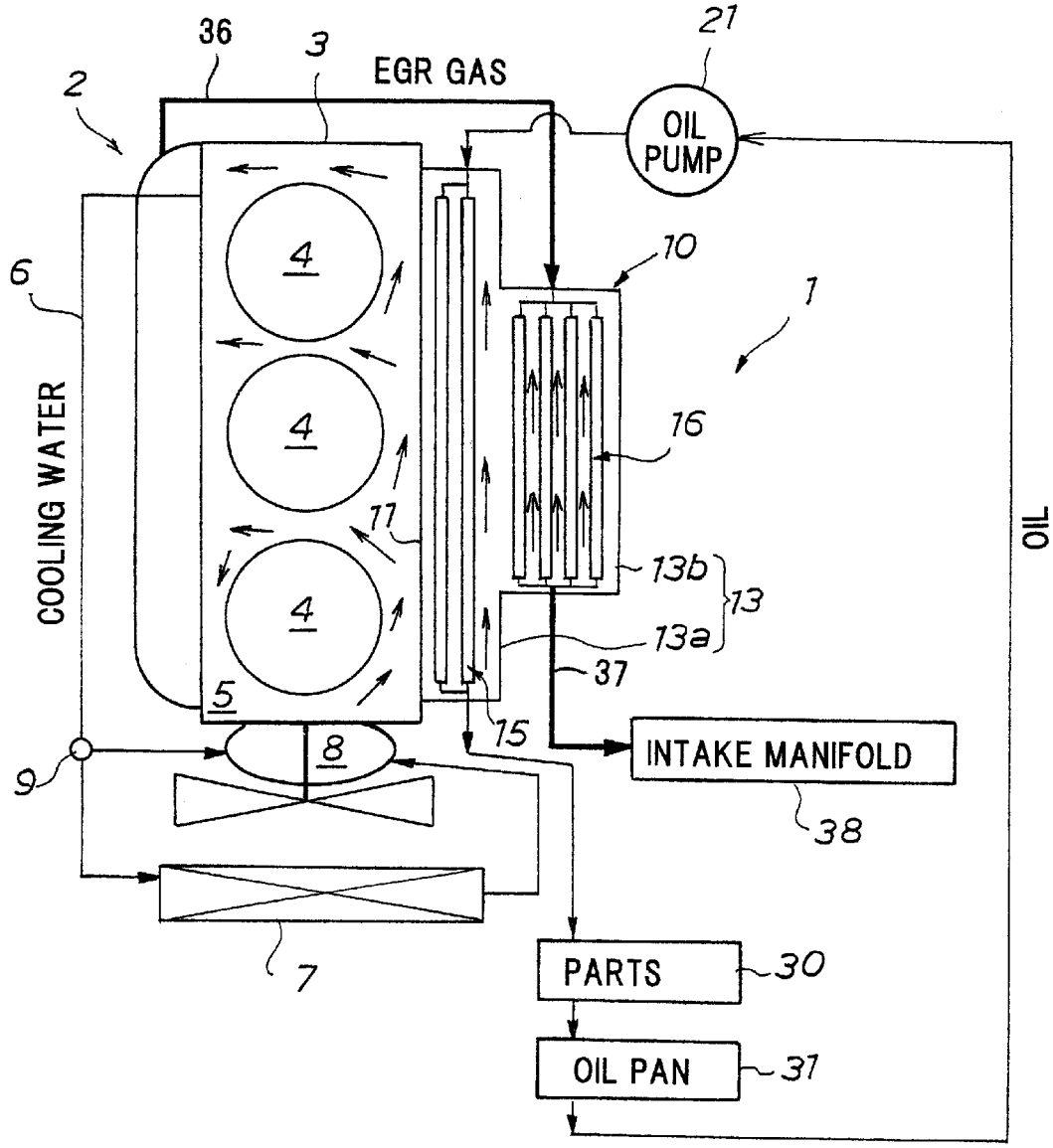
FIG. 1 schematically illustrates an overall structure of a system for cooling EGR gas and lubrication oil according to the present invention.

Referring to FIG. 1, illustrated is an engine 2 having a cylinder block 3 which includes a plurality of cylinder bores 4. Three bores 4 are shown in the drawing, and a water jacket 5 is formed around the bores 4. Cooling water in the water jacket 5 flows to a radiator 7 via a pipe 6 and is cooled therein. The cooling water is then pressurized by a water pump 8 and returned to the water jacket 5. A thermostat 9 is provided on the water passage 6 for introducing the cooling water into the water pump 8, bypassing the radiator 7, when the cooling water temperature is below a predetermined value, and into the radiator 7 when the cooling water temperature is equal to or more than the predetermined value.

Figure 7:
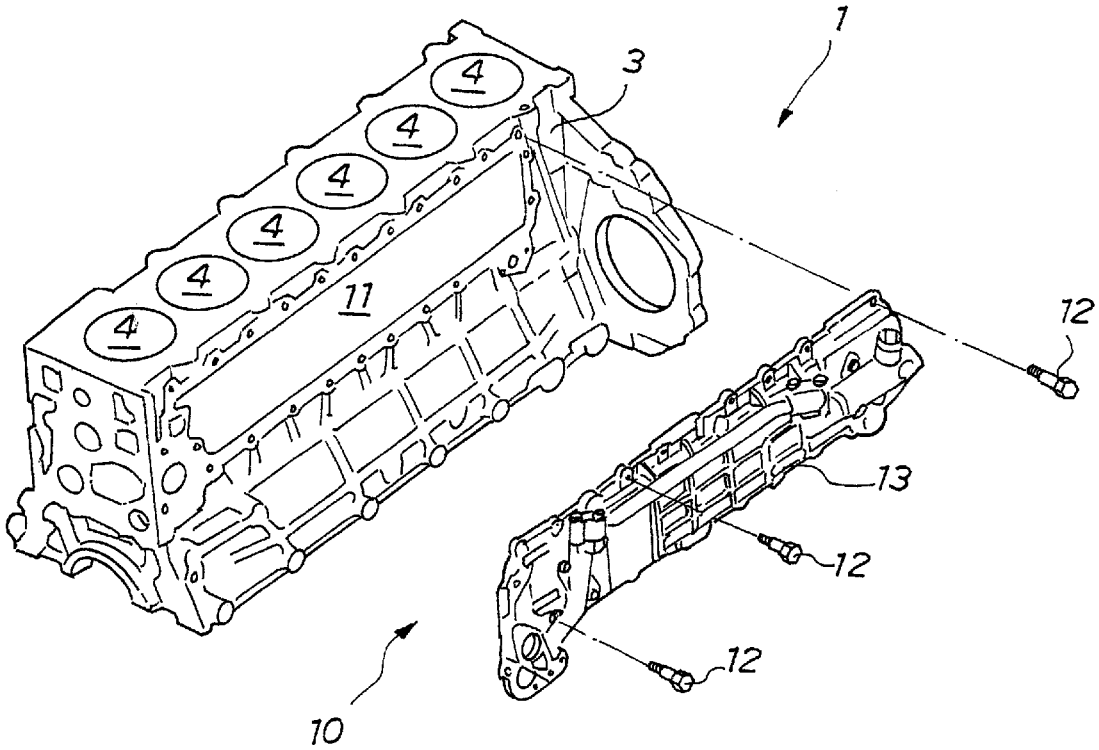
FIG. 7 is an exploded perspective view of a cylinder block and the cover.

On a lateral wall of the cylinder block 3, attached is a cooler housing 10. The cooling water flows into and out of this cooling housing 10. As illustrated in FIG. 7, the cooler receptacle 10 is defined by an opening 11 in the lateral wall of the cylinder block 3, and a cover 13 placed over the opening 11 and secured by bolts 12. The opening 11 exposes part of the water jacket so that the interior of the cover 13 is filled with the cooling water from the water jacket 5. As depicted in FIG. 1, the cooling water in the cover 13 flows in a similar manner to that in the cooling jacket 5.

Figure 4:
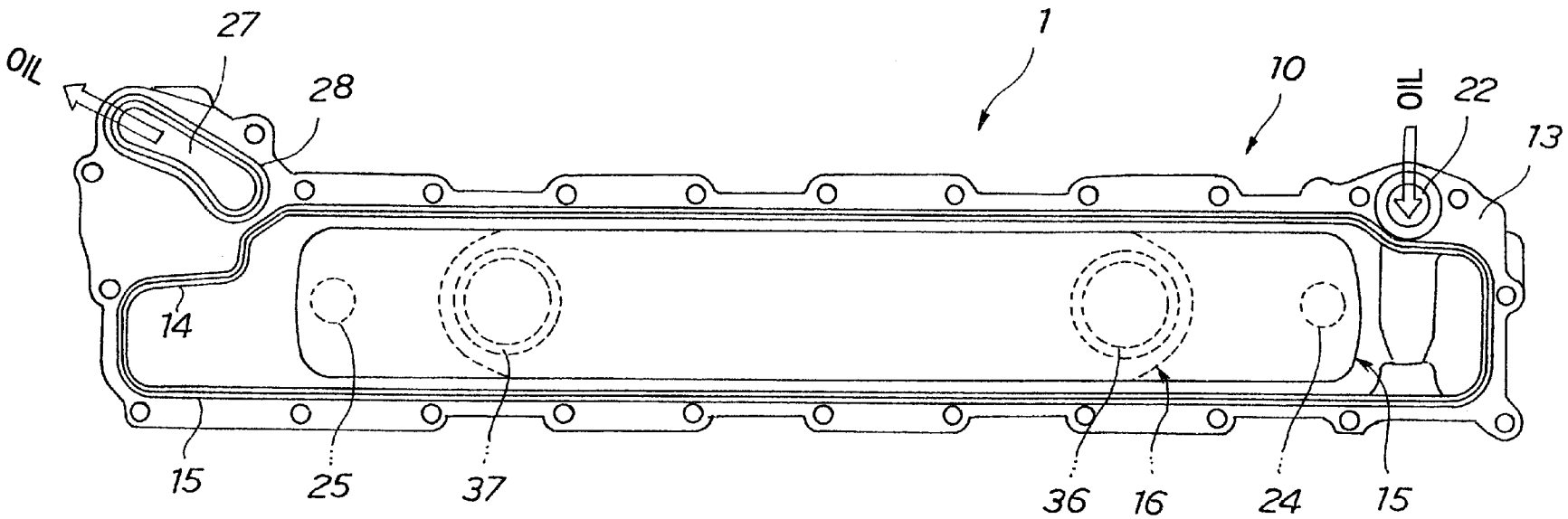
FIG. 4 illustrates an inner face of the cover as viewed in the arrow IV—IV direction in FIG. 2.

Referring to FIG. 4, illustrated is an inner face of the cover 13. Along the periphery 14 of the cover 13, provided is an annular packing 15 for preventing leakage of the cooling water.

Referring back to FIG. 1, the cover 13 includes an oil cooler cover 13*a* that is elongated in the longitudinal direction of the engine 2 and has a relatively small depth in the width direction of the engine, and an EGR cooler cover 13*b* that is shorter than the oil cooler cover 13*a* in the engine longitudinal direction and deeper than the oil cooler cover 13*a* in the width direction. An oil heat exchanger 15 is placed in the oil cooler cover 13*a*. Lubrication oil flows in the oil heat exchanger 15. An EGR gas heat exchanger 16 is placed in the EGR cooler cover 13*b*. EGR gas flows in the EGR heat exchanger 16. It should be noted that the oil cooler cover 13*a* is closer to the cylinder block 3 than the EGR cooler cover 13*b* in the illustrated embodiment, but their positions may be reversed.

Figure 2:
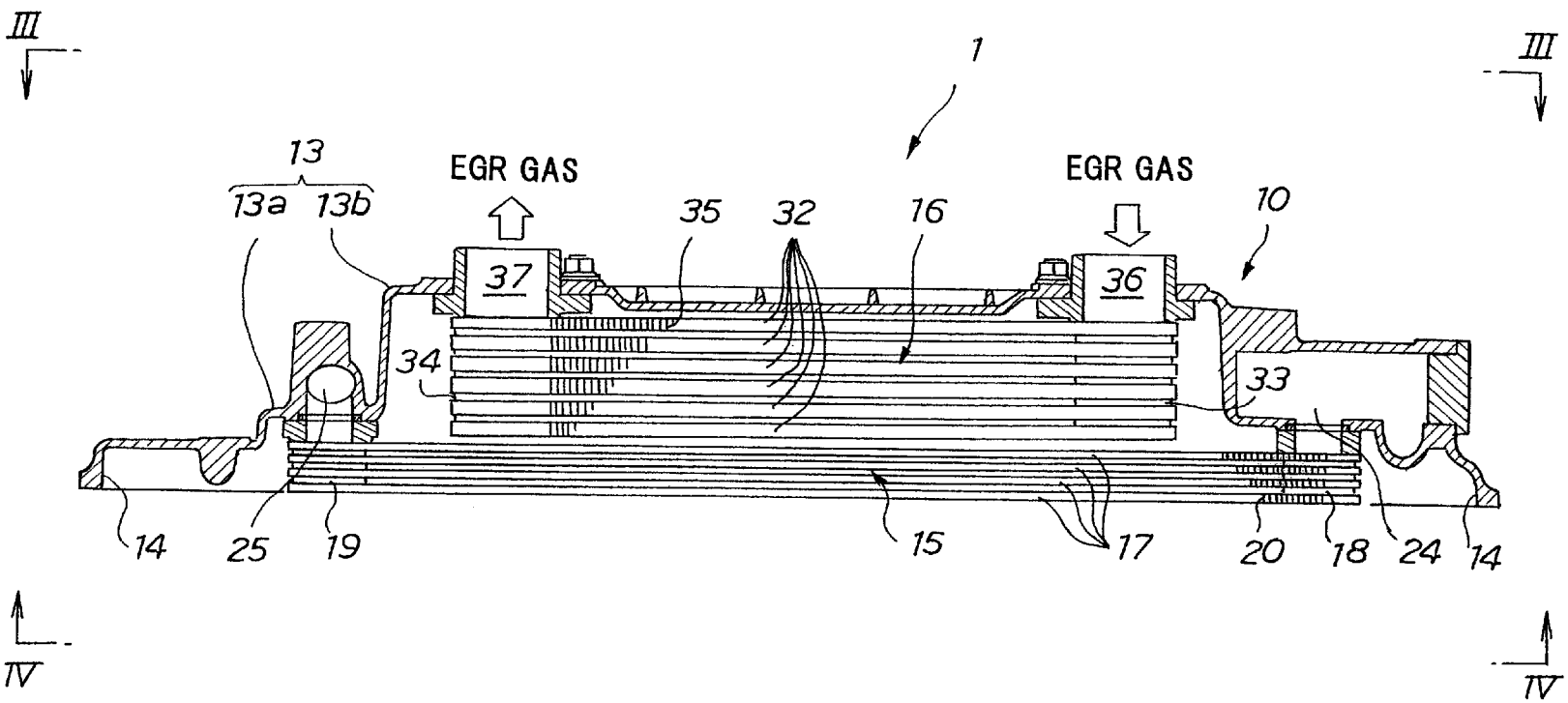
FIG. 2 illustrates an enlarged cross sectional view of EGR gas heat exchanger and lubrication oil heat exchanger used in the cooling system shown in FIG. 1.
Figure 8:
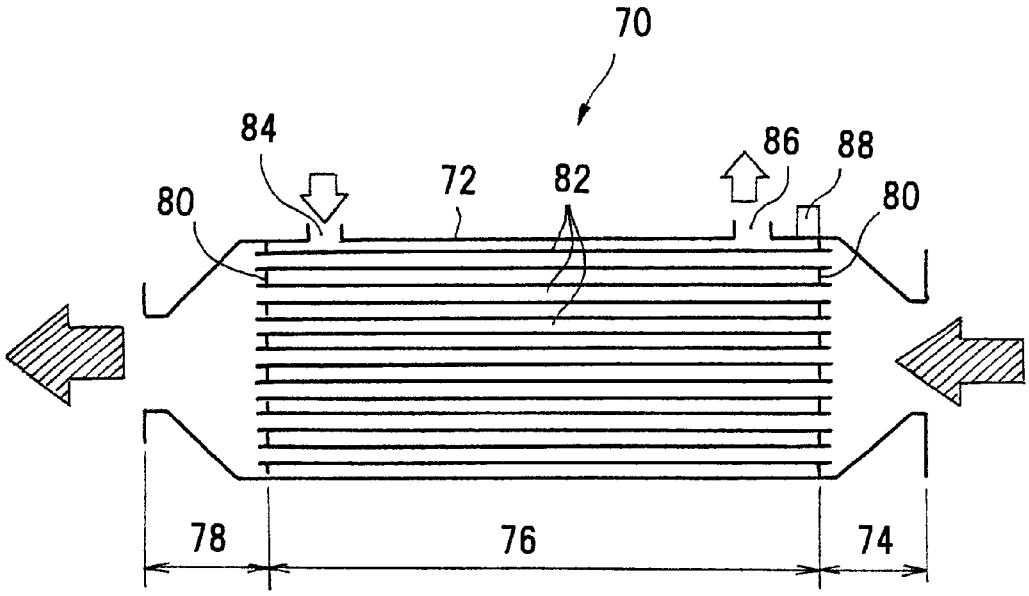
FIG. 8 PRIOR ART
FIG. 8 schematically illustrates a conventional EGR gas cooler.

Referring to FIG. 2, the oil heat exchanger 15 includes a plurality of hollow thin-plate-like bodies 17 stacked one after another, an oil inlet header 18 extending generally vertically through one ends of the hollow bodies 17, and an oil outlet header 19 extending generally vertically through the other ends of the hollow bodies 17. Each hollow body 17 has a number of fins 20 for heat exchange along its periphery. The thin plates 17, oil inlet header 18 and oil outlet header 19 are immersed in the cooling water in the cover 13. It should be noted that the oil heat exchanger 15 is not limited to the plate-stack type as illustrated. For instance, it may be a multi-pipe type as shown in FIG. 8.

As best illustrated in FIG. 1, a pressurized lubrication oil is fed to the inlet header 18 of the oil heat exchanger 15 from an oil pump 21. Specifically, the lubrication oil pressurized by the pump 21 flows into the cylinder block 3 and is admitted to the inside of the cover 13 from an oil entrance 22 (FIG. 4) formed in the back of the cover 13. The oil entrance 22 extends to an oil entrance path 24. Then, as best seen in FIG. 2, the lubrication oil is guided to the inlet header 18 via the path 24, whereby it flows into the thin hollow members 17 and reaches the outlet header 19. Subsequently, the lubrication oil returns to the cylinder block 3 via an oil exit path 25 and oil exit 27 (FIG. 4).

The lubrication oil then is supplied to various parts of the engine, which are collectively designated at 30 in FIG. 1, and collected in an oil pan 31 located below the cylinder block 3. The oil in the oil pan 31 is sucked and pressurized by the oil pump 21 again and reintroduced to the oil heat exchanger 15. As illustrated in FIG. 4, a packing 28 is provided along the periphery of the oil outlet 27 for preventing oil leakage.

Figure 5:
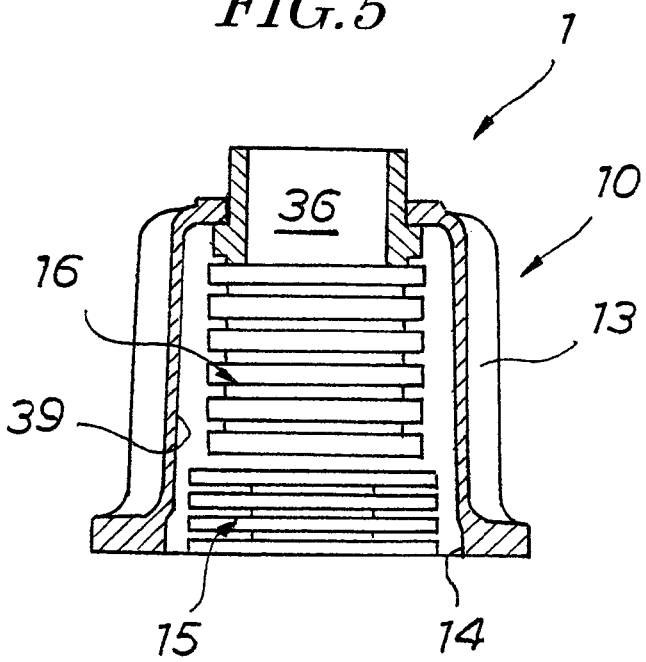
FIG. 5 illustrates a cross sectional view of the cover and two heat exchangers taken along the line V—V in FIG. 3.
Figure 6:
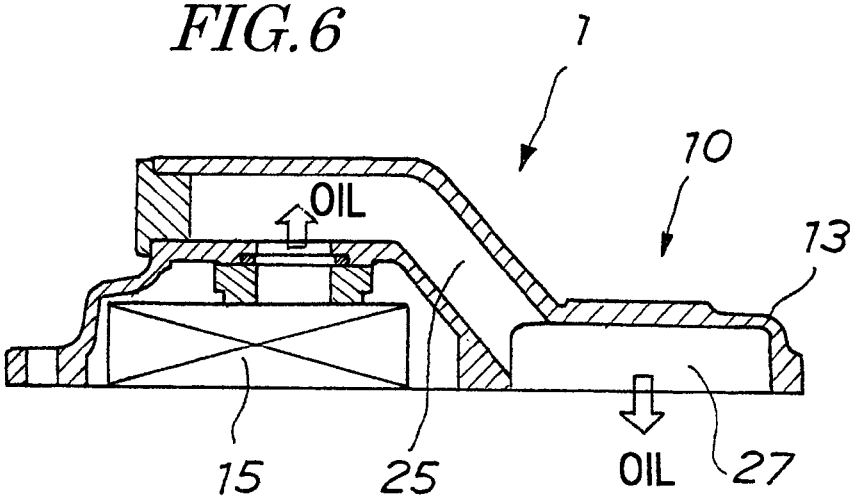
FIG. 6 is a cross sectional view of the cover taken along the line VI—VI in FIG. 3, particularly illustrating a lubrication oil passage.

The EGR heat exchanger 16 is located in the EGR cooler cover 13*b* of the unit cover 13 near the oil heat exchanger 15 as illustrated in FIGS. 1 and 5. As shown in FIG. 2, the EGR heat exchanger 16 includes a plurality of thin hollow plate-like members 32 stacked one after another, an EGR gas inlet header 33 extending generally vertically through one ends of the hollow members 32, and an EGR gas outlet header 34 extending generally vertically through the other ends of the hollow members 32. Each of the hollow members 32 has a number of fins 35 for heat exchange along its periphery. The thin plates 32, EGR gas inlet header 33 and EGR gas outlet header 34 are immersed in the cooling water in the cover 13. It should be noted that the EGR gas heat exchanger 16 is not limited to the plate-stack type as illustrated. For instance, it may be a multi-pipe type as shown in FIG. 8.

Figure 3:
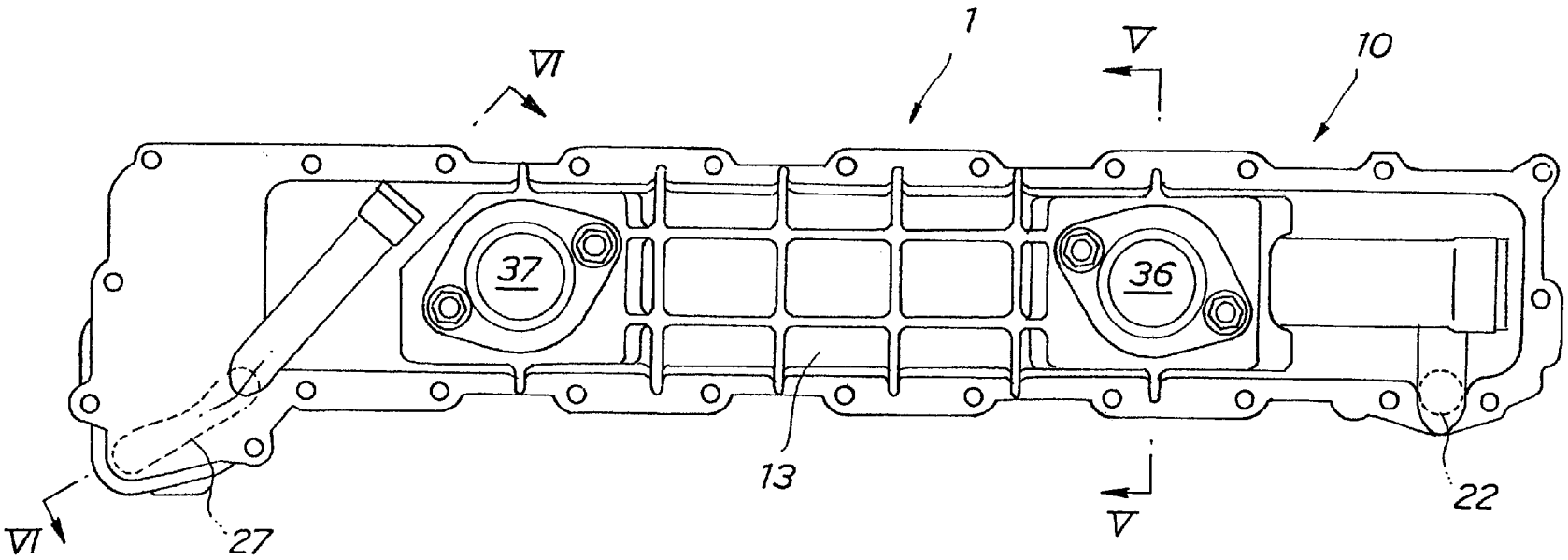
FIG. 3 illustrates a cover for the two heat exchangers as viewed in the arrow III—III direction in FIG. 2.

As illustrated in FIG. 1, part of the exhaust gas from the engine exhaust gas line (exhaust manifold) is introduced to the EGR inlet header 33 through an EGR inlet passage 36. The EGR gas then flows into the thin hollow members 32 as shown in FIG. 2. While the EGR gas is flowing in the hollow members 32, it is cooled by the cooling water in the cover 13 and its density is raised. The EGR gas eventually reaches the outlet header 34 and is introduced to the intake manifold 38 through an outlet passage 37 (FIG. 1). In this manner, EGR efficiency is improved. FIG. 3 illustrates the cover 13 when viewed in the lateral direction.

Now, assembling, operation and advatages of the arrangement 1 for cooling the EGR gas and lubrication oil according to the invention will be described.

As illustrated in FIG. 7, the cover 13 is directly mounted on the upper lateral wall of the cylinder head 3 to cover the opening 11 watertight such that the engine cooling water flows inside the cover 13, thereby defining the cooler housing 10. The EGR gas heat exchanger 16 and oil heat exchanger 15 are placed in this cooler housing 10 so that these heat exchangers are immersed in the cooling water. Accordingly, no piping is necessary for introducing the cooling water to the cooler housing 10 from the engine and returning it to the engine from the cooler housing. Thus, the arrangement 1 never suffers from disadvantages associated with piping such as cracking on pipes. Life of the arrangement 1 is also extended. Further, since there is no piping and the arrangement 1 is integrated to the cylinder block 3, the arrangement 1 requires a less space. This is particularly advantageous because the arrangement 1 should be installed in the engine room, which is already crowded. Moreover, the cooling water is not throttled by pipes but directly applied to the heat exchangers 15 and 16 so that the cooling efficiency of the cooling water is improved. Yet further, since there is no piping unlike the EGR cooler 70 shown in FIG. 8, cavitation that would occur due to boiling of the cooling water in the casing 72 upon clogging of the pipe(s) does not occur.

As depicted in FIGS. 1, 2 and 5, since the EGR gas heat exchanger 16 and oil heat exchanger 15 are located close to each other in the cover 13, heat of the high temperature EGR gas flowing in the EGR heat exchanger 16 is transferred to the low temperature lubrication oil flowing in the oil heat exchanger 15 via the cooling water when the engine is started under a cold condition. Thus, the lubrication oil is heated and its viscosity is lowered. This is particularly advantageous at the cold starting of the engine because the engine oil has high viscosity and the heated oil assists easier start up of the engine and reduces oil pump friction. It should be noted that the thermostat 9 (FIG. 1) causes the cooling water to bypass the radiator 7 when the engine is cold, so that the cooling water can sufficiently heat the lubrication oil.

Air generated upon heating of the cooling water in the cover 13 escapes to the cylinder head through the water jacket 5 of the cylinder block 3. Specifically, such air generated in the cover 13 is guided to the opening 11 (FIG. 7) of the cylinder block 3 along an inclined top wall 39 of the cover 13 (FIG. 5), and eventually escapes to the cylinder head. Therefore, the air ventilation pipe 88 in the conventional EGR cooler 70 shown in FIG. 8 is unnecessary for the cooling system 1 of the invention. No providing the air ventilation pipe and cooling water pipes contributes to cost reduction.

Since the single cover 13 is shared by the two heat exchangers 15 and 16, the manufacturing cost of the cooling system 1 is also reduced as compared with an arrangement having two separate covers for the two heat exchangers respectively.

Since the cylinder block 3 has the single lateral opening 11 shared by the EGR gas heat exchanger 16 and oil heat exchanger 15, its rigidity deterioration by the lateral opening is reduced to the minimum. This is understood if compared with an arrangement having two openings for the two heat exchangers respectively. Maintaining sufficient rigidity of the cylinder block contributes to reduction of engine vibration. Life reduction of associated parts due to the engine vibration is also suppressed.

It should be noted that the opening 11 may be formed in any wall of the cylinder block 3 other than the lateral wall if space is available.

The illustrated and described EGR gas and oil cooling system is disclosed in Japanese Patent Application No. 11-319914 filed on Nov. 10, 1999, the instant application claims priority of this Japanese Patent Application, and the entire disclosure thereof is incorporated herein by reference.

What is claimed is:

1. A system for cooling EGR gas and oil comprising:

a housing directly attached to a cylinder block such that engine cooling water flows in the housing;

an EGR (exhaust gas recirculation) gas heat exchanger placed in the housing such that EGR gas flows in the EGR gas heat exchanger; and an oil heat exchanger placed in the housing adjacent to the EGR gas heat exchanger such that a lubrication oil flows in the oil heat exchanger.

2. The cooling system according to claim 1, wherein the housing includes a cover for covering an opening formed in a wall of the cylinder block such that part of a water jacket is exposed, and for housing the EGR gas heat exchanger and oil heat exchanger.

3. The cooling system according to claim 2, wherein the opening is formed in a lateral wall of the cylinder block, and the oil heat exchanger is positioned closer to the opening than the EGR gas heat exchanger.

4. The cooling system according to claim 1, wherein the oil heat exchanger includes a plurality of thin plate-like hollow members immersed in the engine cooling water in the housing.

5. The cooling system according to claim 1, wherein the EGR gas heat exchanger includes a plurality of thin plate-like hollow members immersed in the engine cooling water in the housing.

6. The cooling system according to claim 1 further including a first passage for introducing an exhaust gas to the EGR gas heat exchanger from an exhaust manifold and a second passage for introducing the exhaust gas to an intake manifold from the EGR gas heat exchanger.

7. The cooling system according to claim 1, wherein the housing is shaped to guide air generated upon heating of the engine cooling water in the housing to a water jacket thereby allowing the air to escape to a cylinder head.

8. The cooling system according to claim 1, wherein the oil heat exchanger and EGR gas heat exchanger are located in parallel in a width direction of the engine.

* * * * *